United States Patent [19]

Hibari

[11] 4,429,408

[45] Jan. 31, 1984

[54] DEVICE FOR PREVENTING FAULTY COUNTING OPERATIONS IN A PAPER SHEET COUNTER

[75] Inventor: Eikoh Hibari, Tokyo, Japan

[73] Assignee: Laurel Bank Machine Co., Ltd., Tokyo, Japan

[21] Appl. No.: 280,482

[22] Filed: Jul. 6, 1981

[30] Foreign Application Priority Data

Jul. 8, 1980 [JP] Japan ..... 55-95927[U]

[51] Int. Cl.[3] ..... B65H 3/12

[52] U.S. Cl. ..... 377/8; 271/95; 271/154

[58] Field of Search ..... 377/6, 8, 16, 28, 30, 377/53; 355/3 SH, 14 SH; 340/674; 271/95, 154, 155, 263

[56] References Cited

U.S. PATENT DOCUMENTS

| | | | |
|---|---|---|---|
| 3,953,022 | 4/1976 | Oshima | 271/95 |
| 4,135,709 | 1/1979 | Uchida et al. | 377/30 |
| 4,275,879 | 6/1981 | Yamashita | 340/674 |
| 4,323,768 | 4/1982 | Uchida | 271/95 |

*Primary Examiner*—Gary Chin

*Attorney, Agent, or Firm*—Fleit, Jacobson, Cohn & Price

[57] ABSTRACT

Device for preventing double counting is provided, which is to be used in a paper sheet counting apparatus having a holder for moving between a paper sheet depositing position and a paper sheet counting position, a rotating cylinder provided with a plurality of suction heads for sucking and turning over paper sheets one by one for counting when the holder is moved to the paper sheet counting position, and a counting device for counting the number of paper sheets. The device according to the invention includes a start sensor for detecting paper sheets deposited into the holder, a paper sheet sensor for detecting the presence or absence of paper sheet at the paper sheet depositing position, and a control circuit for instructing the counting operation to start. The control circuit, upon reception of the detection signals form the start sensor and paper sheet sensor, generates an instruction signal for starting a counting operation and inhibits the counting operation while the paper sheet sensor continues to detect the paper sheets.

5 Claims, 5 Drawing Figures

DEVICE FOR PREVENTING FAULTY COUNTING OPERATIONS IN A PAPER SHEET COUNTER

BACKGROUND OF THE INVENTION

1. Field of the Invention:

This invention relates generally to a paper sheet counting apparatus, and particularly to a device for preventing faulty counting of the paper sheets being handled in apparatus. Generally in a paper sheet counting apparatus, a bundle of paper sheets is charged in a holder which is movable between a depositing position and a counting position. Then, the holder is moved to the counting position in which the bundle of the paper sheets is counted. After the counting operation has been completed, the holder is returned back to the initial depositing position where the counted paper sheets aare removed ready for the next cycle of counting.

2. Prior Art:

In the prior art paper sheet counting apparatus, for instance in a bank note counting machine used in a bank, paper sheets charged in a holder positioned at a depositing position are detected by a detector, for example including a photoelectric element. The holder is then driven to swingably move to the counting position in response to a start signal generated by the detector. The counting operation is started after the holder is swung to the counting position. After completion of one cycle of counting operation, the holder is returned back to the initial charging position to be ready for the next cycle of counting. If the bundle of paper sheets is moved back to the initial depositing position together with the holder returning back to the depositing position when one cycle of counting operation is terminated, the detector again senses the bundle of paper sheets so that the next cycle of counting operation re-starts again. In order to eliminate the aforementioned risk, it has been proposed, by our co-pending Japanese Utility Model Application No. 18789/1978, to provide mechanical means to prevent only the bundle of paper sheets from being returned back to the initial depositing position even when the holder is retracted to the initial depositing position upon completion of one cycle of counting operation.

The device proposed by our co-pending application referred to above for preventing erroneous double-counting, will be described in detail hereinbelow.

Referring to FIG. 1 showing, in plan, a paper sheet counting machine provided with a device according to the preceding proposal for preventing double-counting, when the bundle of paper sheets 2 is loaded into a holder positioned at its initial or retracted position, as shown in FIG. 1, a light which is emitted from a light emitting element L1 and received by a photo-transistor P1 is shielded by the lower and forehand end of a bundle of paper sheets 2. A counting operation control circuit, not shown, connected with the photo-transistor P1 instructs the movement of the holder and controls the operation of the counting of the paper sheets from the bundle 2 in response to the change in output from the photo-transistor P1, whereupon the holder 1 is swung about an axis 3 in the direction shown by arrow 4 together with the bundle of paper sheets 2. During this movement of the holder, the bundle of paper sheets 2 passes a blocking piece, made, for example, of a leaf spring 5, while depressing the fore end of the leaf spring 5. (Reference should be made also to FIG. 2 showing the front view of the counting section of the device of FIG. 1.) Thus, the paper sheets are pressed on one of the suction heads 8 of a suction cylinder 7 rotating in the direction shown by arrow 6 while being clamped in-between the holder 1 and a clamping rod 12'. Since the suction heads 8 have suction ports (not shown) and rotate in the direction shown by arrow 9, paper sheets are sucked and turned over one by one from the bundle of paper sheet 2 to be counted. Reference numerals 10 and 11 designate, respectively, a guide plate and support plate for guiding the forehand end of the bundle of paper sheets 2 as the holder 1 swings.

The holder 1 is moved in the reverse direction to the arrow 4 to be returned to the initial position upon completion of one cycle of counting operation. However, the bundle of paper sheets 2 is blocked by the blocking piece 5 to be prevented from returning back to the initial position, ad shown in FIG. 2, so that the light emitted from the light emitting element L1 and received by the photo-transistor P1 is not shielded to prevent double-counting.

As described above, the device of the preceding proposal prevents double-counting by the provision of mechanical means. However, in this known device, the forehand free end of the resilient blocking piece must be positioned at a vertical position accurately and the spring force thereof must be delicately adjusted. If the positioning and adjustment of the spring force are not done pertinently, there is a possibility that a malfunction of the device would occur. In detail, if the forehand free end of the blocking piece 5 is positioned too low, the bundle of paper sheets 2 might not be blocked thereby to be restored to the initial position. If the spring force of the blocking piece 5 is too strong, the bundle of paper sheets 2 is raised upwards by the spring action of the blocking piece 5 to a position at which the lower forehand end of the bundle does not shield the light emitted from the light emitting element L1 and received by the photo-transistor P1. As a result, a signal for instructing the movement of the holder to start would not be generated. In addition, care must be taken so that the paper sheets 2 are not torn or damaged by the scratching action of the blocking piece 5 when the bundle of paper sheets 2 is returned to the initial position after the completion of counting operation. As will be apparent from the foregoing, the known device provided with mechanical means for preventing double-counting has various disdvantages, although it operates to attain the aimed objective.

OBJECTS AND SUMMARY OF THE INVENTION

This invention is accomplished to eliminate the aforementioned disadvantages of the known device.

More specifically, the principal object of this invention is to provide a device for preventing faulty counting wherein double-counting is prevented by optical and electrical means rather than mechanical means.

Another object of this invention is to provide a device for preventing faulty counting which operates reliably without delicate adjustment.

A further object of this invention is to provide a device for preventing faulty counting which has no part or member physically contacting with or abutting against any portion of the bundle of paper sheets.

A still further object of this invention is to provide a device for preventing faulty counting which can be operated easily and safely.

In order to attain the aforementioned objects, the present invention provides a device for preventing faulty counting, which comprises a start sensor including a paired set of light emitting and receiving elements, a paper sheet detecting sensor including another paired set of light emitting and receiving elements, and a control circuit for instructing initiation and termination of counting operation in response to the signals generated from the start sensor and the paper sheet detecting sensor.

DESCRIPTION OF THE DRAWINGS

The above and other objects and advantages of this invention will be more fully understood in view of the following description of the presently preferred embodiment thereof with reference to the accompanying drawings, in which.

DESCRIPTION OF THE PREFERRED EMBODIMENT

Figure 5:
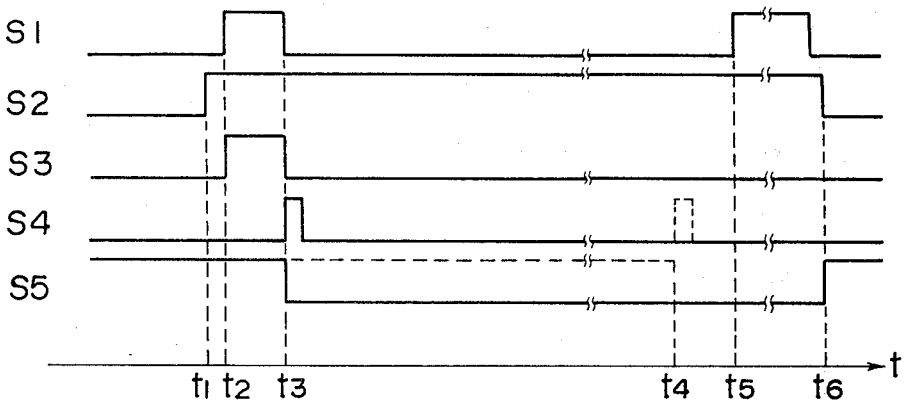
FIG. 5 is a time-chart showing the operation of the embodiment of this invention shown in FIGS. 3 and 4.

An embodiment of this invention will now be described by referring to FIGS. 3 to 5.

Figure 1:
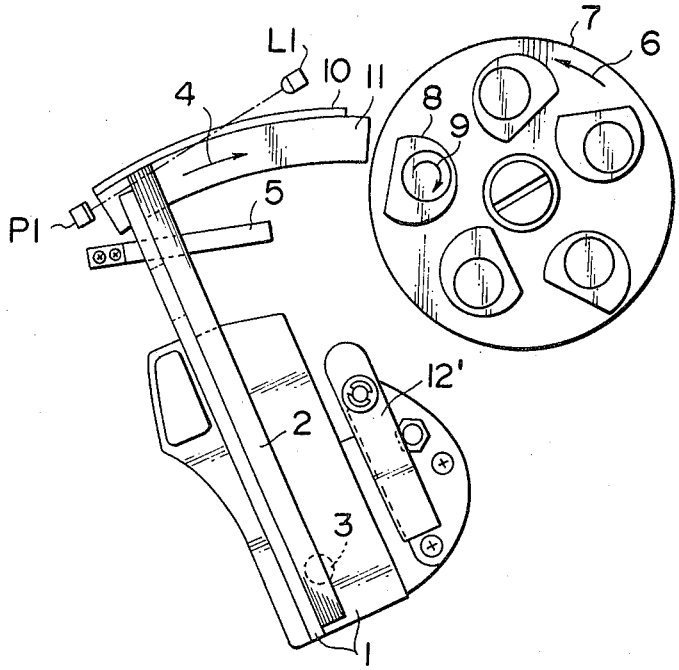
FIG. 1 PRIOR ART
FIG. 1 is a partial plan view of a counting section of a prior art counting machine provided with a known device for preventing faulty counting.
Figure 2:
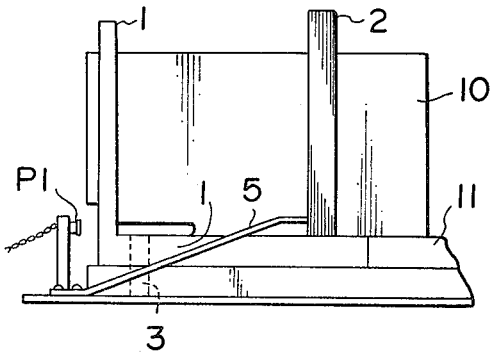
FIG. 2 PRIOR ART
FIG. 2 is a schematic representation of the counting section shown in FIG. 1, showing the main parts thereof in front view.
Figure 3:
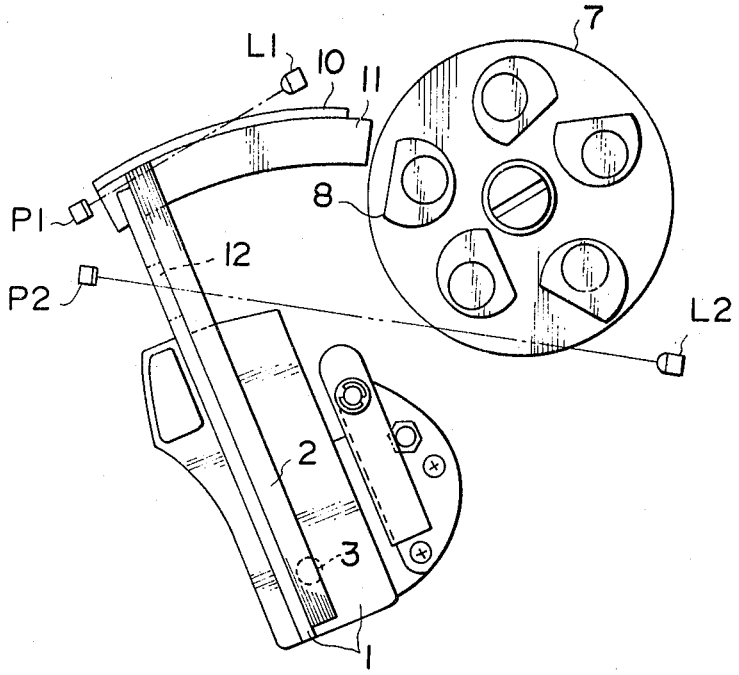
FIG. 3 is a partial plan view of a counting section of a device of this invention, showing an exemplified arrangement schematically.

Firstly referring to FIG. 3 showing a counting section embodying the present invention, similar parts shown in FIG. 3 are denoted by the same reference numerals as in FIGS. 1 and 2. A paper sheet sensor includes a light emitting diode L2 and a photo-transistor P2. A light which is emitted from the light emitting diode L2 and received by the photo-transistor P2 is shielded by a bundle of paper sheets 2 when the paper sheets are charged in the holder 1. The light emitting diode L2 and the photo-transistor P2 are arranged so that the charged bundle of paper sheets 2 is always sensed wherever it is moved together with the holder 1. With such an arrangement, the bundle of paper sheets 2 is sensed by the paper sheet sensor irrepective of its position relative to the rotating suction cylinder 7. Alternatively, the holder 1 may be provided with a through-hole 12, and the light emitting diode L2 and the photo-transistor P2 may be arranged so that the bundle of paper sheets 2 is sensed only when the bundle of paper sheets 2 is positioned at the initial charging position by the holder 1. With this arrangement, the holder 1 per se shields the light for allowing the photo-transistor P2 to generate a signal instructing the movement of the holder and the subsequent counting operation to start. This arrangement has another advantage that the presence or absence of paper sheets can be detected at the initial depositing position to confirm charging or discharging of the bundle of paper sheets 2 into or out of the holder 1.

Figure 4:
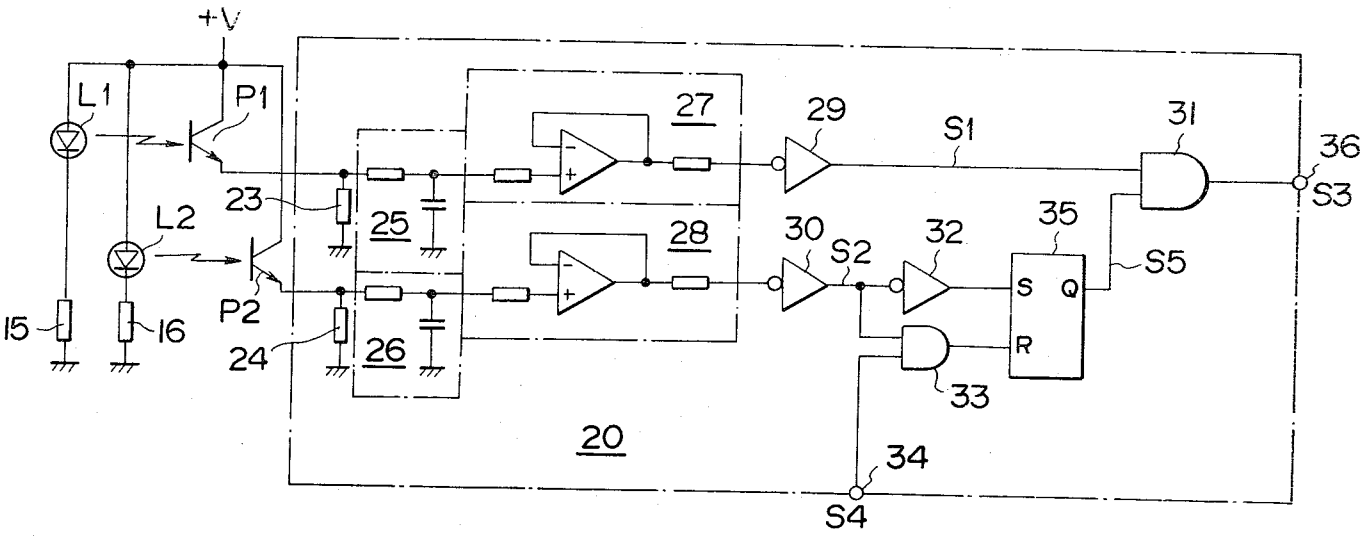
FIG. 4 is a diagram showing an embodiment of the control circuit assembled with the counting section of the device shown in FIG. 3.

Now referring to FIG. 4 showing the arrangement of a control circuit 20 which is assembled with the embodiment shown in FIG. 3, the anodes of the light emitting diode L1 and L2 are connected to a power source +V and the cathodes thereof are connected through resistances 15 and 16 to earth. The light emitting diodes L1 and L2 emit light constantly when they are connected to the power source to be energized. The collectors of the photo-transistors P1 and P2 are also connected to the power source +V, and the emitters thereof are connected to load resistors 23 and 24 and also connected to input terminals of filter circuits (low-pass filters) 25 and 26. The output terminals of the filter circuits 25 and 26 are connected, respectively, to input terminals of amplifiers 27 and 28. The output terminals of the amplifiers 27 and 28 are connected to input terminals of inverters 29 and 30. The output terminal of the inverter 29 is connected to a first input terminal of a two-input AND gate 31, and the output terminal of the inverter 30 is connected to an input terminal of another inverter 32 and also to a first input terminal of a two-input AND gate 33. The signal from the output terminal of the inverter 29 will be referred to as signal S1 and the signal from the output terminal of the inverter 30 will be referred to as signal S2, in the following description. The two-input AND gate 33 has a second input terminal 34 to which a counting control signal S4 is supplied. The detailed description of the counting control signal S4 will be given hereinafter. The output terminal of the inverter 32 is connected to a set input terminal S of an SR type flip-flop (hereinafter referred to as SRFF) 35, and the output terminal of the two-input AND gate 33 is connected to a reset input terminal R of the SRFF 35. The SRFF 35 has a set output terminal Q, the signal from this set output terminal Q being referred to as a signal S5, which is connected to a second input terminal of the two-input AND gate 31. The output terminal of the two-input AND gate 31 has an output terminal 36 through which a start signal S3 is put out. The start signal S3 in this embodiment is a signal for instructing the movement of the holder and the counting operation to start which is fed to a counting control circuit (not shown) to energize the same to start the above-mentioned operations. The counting control signal S4 is generated by the counting control circuit for the purpose of confirmation, and the signal S4 is fed back to the control circuit 20.

The operation of this embodiment will be specifically described with reference to the time chart shown in FIG. 5 together with FIGS. 3 and 4, while using the binary logical levels "1" and "0". At the initial stage, assuming that the holder 1 shown in FIG. 3 has not yet been charged with the bundle of paper sheets 2, the photo-transistors P1 and P2 are on so that electric currents supplied from the power source +V are passed through the photo-transistors P1 and P2 and through the filter circuits 25 and 26 to the input terminals of the amplifiers 27 and 28 to hold the signals fed to these input terminals at the high level so that the signal from the output terminals of the amplifiers 27 and 28 are "1". Accordingly, the signal S1 is "0", and the signal S2 is also "0". On the other hand, the signal S5 is "1", since the output signal from the inverter 32 is "1" so that the SRFF 35 is in the set condition. The start signal S3 is "0", since the signal S1 is at "0", and the counting control signal S4 is also "0". When a bundle of paper sheets 2 is charged, both of the photo-transistors P2 and P1 are turned off although the latter transistor P1 is cut off after some time lag from the cut-off time of the former transistor P2, whereupon the signal S2 takes the level "1" at the time $t_1$ so that the output from the inverter 32 becomes "0". At this time, the signal S5 is held at "1", since the SRFF 35 is not reset because the counting control signal S4 is held at "0" lost. On the other hand, the signal S1 takes the level "1" at the time $t_2$ so that the start signal S3 is brought to "1" under the condition at which the signal S5 is held at "1" as mentioned above. In response to generation of the signal S3 taking the level "1" at the time $t_2$, the movement of the holder and the subsequent counting operation are started. As the result, the holder 1 is swung toward the rotating cylinder 7 together with the bundle of paper sheets 2 so that the photo-transistor P1 comes to receive a light, whereupon the signal S1 takes the level "0" at the time $t_3$ so that the start signal S3 also takes the level "0".

The counting control circuit puts out a control signal S4 after the lapse of a predetermined period of time. In this embodiment, the counting control signal S4 is put out at the time $t_3$ when the start signal S3 has fallen. In response to this counting control signal S4 fed through the two-input AND gate 33, the SRFF 35 is reset at the time $t_3$ since the signal S2 is held at "1". As a result, the signal S5 takes the level "0" so that the start signal S3 is inhibited.

After that, the start signal S3 is not generated even when the start sensor detects the paper sheets as the holder 1 and the bundle of paper sheets 2 are returned back to the initial position, i.e. the photo-transistor P1 is de-energized under the condition at which the light is shielded for allowing the signal S1 to take the level "1" at the time $t_5$. Namely, the movement of the holder and the counting operation are never repeated erroneously.

In order to generate the start signal S3, it is essential that the SRFF 35 shall be set once so as to allow the signal S5 to take the level "1". This condition is satisfied only when the paper sheet sensor has not detected the bundle of paper sheets 2, i.e. when the bundle of paper sheets 2 is removed from the holder 1 to allow the photo-transistor P2 to receive the light at the time $t_6$, as shown in FIG. 5, so that the signal S2 takes the level "0" again.

Although, in the illustrated embodiment, the counting control signal S4 is generated when the start signal S3 has fallen, the signal S4 may be generated at any time before the time $t_5$ when a signal for swinging the holder 1 together with the bundle of paper sheets 2 back to the initial position is generated and the start sensor detects the paper sheets. For instance, the counting control signal S4 may be generated at the time $t_4$.

As will be appreciated from the foregoing description, the device for preventing double-counting according to this invention comprises a start sensor for detecting paper sheets charged into the holder positioned at the retracted or initial position, a paper sheet sensor for detecting the presence or absence of paper sheet on the holder, and a control circuit for instructing the counting operation to start, the control circuit being constructed so that the signal instructing the movement of the holder and the counting operation to start is never generated again as the paper sheet sensor detects the paper sheet after a signal for starting one cycle of counting operation has been generated. By the use of the device of this invention, erroneous double-counting is excluded reliably without employing mechanical means which require delicate adjustment and yet occasionally cause double or repeated counting.

Although the present invention has been described by referring to a presently preferred embodiment thereof, it should be apparent to those skilled in the art that many modifications and changes may be made without departing from the spirit and scope thereof. The illustrated embodiment is, therefore, to be considered in all respects as illustrative only and not restrictive. The scope of the invention is limited only by the appended claims, and all changes of equivalents which come within the meaning and range of the claims are to be embraced therein.

What is claimed is:

1. In a paper sheet counting apparatus comprising a holder for moving between a paper sheet depositing position and a paper sheet counting position, a rotating cylinder provided with a plurality of suction heads for sucking and turning over paper sheets one by one from said holder when the holder is moved to said paper sheet counting position, and counting means for counting the number of paper sheets sucked by said suction heads, the improvement comprising a device for preventing a faulty counting operation of the paper sheet, said device comprises a start sensor for detecting paper sheets loaded into said holder and for producing a first detection signal in response thereto, a paper sheet sensor for detecting the presence of said paper sheet in both said depositing position and said counting position and for producing a second detection signal in response thereto, and a control circuit for instructing the movement of the holder and counting operation to start, said control circuit receiving the detection signals from said start sensor and said paper sheet sensor and generating, upon reception of said detection signals, sequential instruction signals for starting one cycle of counting operation and for inhibiting subsequent instruction signals while the paper sheet sensor continues to detect the paper sheets.

2. A device for preventing a faulty counting operation as claimed in claim 1, wherein said start sensor includes a paired set of light emitting diode and photo-transistor and said paper sheet sensor includes another paired set of light emitting diode and photo-transistor.

3. A paper sheet counting apparatus in which paper sheets are moved from a paper sheet depositing position to paper sheet counting position with said paper sheets being held on a holder, counted in said counting position by sucking and turning over said paper sheets one by one by a plurality of suction heads provided on a rotary cylinder, and then caused to return to said loaded position, which comprises a start sensor for detecting the presence of said paper sheets in said depositing position to generate a first signal, a paper sheet sensor for detecting the presence of said paper sheets in both said depositing position and said counting position to generate a second signal, start signal issuing means for issuing a start signal in response to said first signal and second signal to move said holder from said depositing position to said counting position, inhibiting means for inhibiting a second issuance of said start signal until said paper sheet sensor does not detect the presence of said paper sheets, whereby a faulty counting operation of the paper sheets is prevented.

4. A paper sheet counting apparatus as set forth in claim 3, wherein said inhibiting means includes a set-reset flip-flop, a set terminal of which receives said second signal through an inverter, a reset terminal of which is connected to an AND gate wherein one input terminal thereof receives said second signal and another input terminal thereof receives a counting control signal, and an output terminal of said flip-flop issues a third signal for enabling said start signal issuing means when said flip-flop is set.

5. A paper sheet counting apparatus as set forth in claim 4, wherein said flip-flop is reset in response to said second signal and said count control signal through said AND gate to inhibit an issuance of said start signal.

* * * * *